United States Patent [19]

Hruda et al.

[11] 4,388,504

[45] Jun. 14, 1983

[54] SWITCH OPERATING MEANS INCLUDING LATCHING MEANS MAINTAINING SWITCH CONTACTS OPEN OR CLOSED

[75] Inventors: Robert M. Hruda; John L. Cusimano, both or Horseheads, N.Y.

[73] Assignee: Westinghouse Electric Corp., Pittsburgh, Pa.

[21] Appl. No.: 276,766

[22] Filed: Jun. 24, 1981

[51] Int. Cl.[3] ..... H01H 15/18

[52] U.S. Cl. ..... 200/76; 200/83 S; 200/83 P; 200/325

[58] Field of Search ..... 200/76, 302, 83 S, 83 P, 200/325

[56] References Cited

U.S. PATENT DOCUMENTS

| | | | |
|---|---|---|---|
| 3,036,173 | 5/1962 | Perkins | 200/83 P |
| 3,242,282 | 8/1963 | Suzuki | 200/76 |
| 3,330,925 | 7/1967 | Andrew et al. | 200/83 P |
| 3,402,374 | 9/1968 | Gaines et al. | 200/76 |
| 3,585,334 | 6/1971 | Hellman | 200/302 |
| 3,588,395 | 6/1971 | Hersey | 200/83 S |
| 3,876,845 | 4/1975 | Griffith et al. | 200/76 |
| 4,097,039 | 7/1978 | Barkan | 200/144 B |
| 4,169,390 | 10/1979 | Schultz et al. | 200/83 S X |
| 4,216,359 | 8/1980 | Hruda | 200/144 B |
| 4,225,763 | 9/1980 | Barkan | 200/144 B |

*Primary Examiner*—Stephen Marcus
*Assistant Examiner*—Renee S. Kidorf
*Attorney, Agent, or Firm*—W. G. Sutcliff

[57] ABSTRACT

A latching mechanism for a reciprocable actuating means which has a short linear reciprocable stroke between two opposed positions at opposed ends of the actuating stroke. The actuating means is designed for operating an electrical shunt switch useful with electrochemical cells. The latching mechanism operates to maintain the switch contacts in either the open contact or closed contact positions until a positive unlatching force is applied to permit movement of the contacts.

3 Claims, 3 Drawing Figures

SWITCH OPERATING MEANS INCLUDING LATCHING MEANS MAINTAINING SWITCH CONTACTS OPEN OR CLOSED

BACKGROUND OF THE INVENTION

The present invention relates to an improved operating mechanism for an electrical switch. More particularly, an operating mechanism is described exhibiting a bi-stable condition which maintains the switch contacts in a closed or opened position until a positive unlatching force is applied to overcome the latching force of the operating mechanism, to permit the switch contacts to be switched from open circuit condition to closed current carrying position or vice versa.

The operating mechanism of the present invention is particularly designed to be used with a low DC voltage, high continuous current electrical shunting switch assembly used for shunting electrochemical cells. In such switch assemblies, the shunting switch preferably has a hermetically sealed body which is evacuated, with high conductivity, cylindrical, reciprocably movable switch contacts sealed through opposed body portions of the switch. Such a shunting switch is set forth in U.S. Pat. No. 4,216,359, and includes an operating mechanism in which a reciprocable mechanical link is connected to one switch contact to effect opening and closing of the switch contacts. In this earlier design, the reciprocable mechanical link included Belleville washer overtravel spring means and a rocking cam link portion which cooperated to latch the switch contacts in the closed contact position, and required a positive unlatching force to be applied to open the switch contacts.

It is highly desirable that the switch contacts be latched or maintained in bi-stable open or closed contact position to prevent accidental switch operation from one contact position to the other. The use of an air or hydraulic cylinder operating mechanism has been proposed for applying the reciprocal force needed to open and close the switch contacts of such electrochemical cell shunting switches. It is desirable to provide as part of such air or hydraulic cylinder operating mechanism a latching means for keeping the contacts open or closed in case of loss of air pressure or hydraulic pressure. It is important to avoid accidental switch closing as well as accidental switch opening because of the potential danger to maintenance personnel working on the cell to which the switch assembly is connected. In typical cell systems, thousands of amperes of low DC voltage continuous current will be flowing either through the cell or the shunt switch. It is thus extremely important that a workman be assured that no accidental current switching takes place while he is working on the non-current carrying portion of the system.

The use of Belleville washers or disc springs as part of vacuum circuit breaker operating mechanisms is seen in U.S. Pat. No. 4,099,039 and U.S. Pat. No. 4,225,763, in which the disc spring is employed to eliminate momentary contact separation or contact bounce upon switch contact closing.

SUMMARY OF THE INVENTION

An improved operating mechanism for low DC voltage, high continuous current electrical shunting switch assemblies to provide a stable open or closed contact position. The operating mechanism includes reciprocating actuating means and a latching means comprising a Belleville washer connected between the reciprocating actuating means and a rigid mounting means. This latching means applies a force on the contacts in both the open and closed contact position to keep the switch contacts in the given contact position, and requiring a predetermined unlatching force to be applied to overcome the latching force supplied by the Belleville washer to permit switch contact movement.

DESCRIPTION OF THE PREFERRED EMBODIMENT

Figure 1:
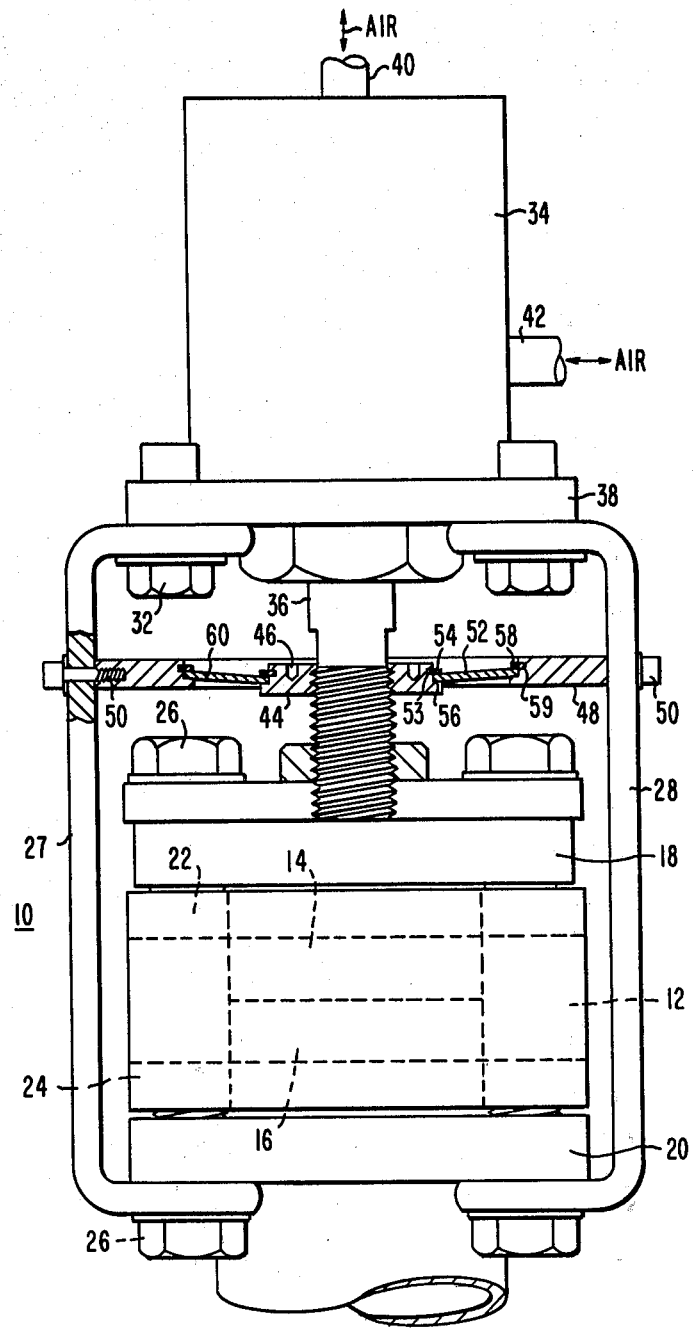
FIG. 1 is an elevational view partly in section of a switch assembly and improved operating mechanism per the present invention in the closed contact position.

The invention can be best understood by reference to the exemplary embodiment shown and explained in the drawings herewith.

In FIG. 1, the shunting switch assembly 10 includes a vacuum switch 12 as is more fully described in detail in U.S. Pat. No. 4,216,359 or U.S. Pat. No. 4,216,361. In general, the vacuum switch 12 includes cylindrical contacts 14 and 16 which are hermetically sealed through opposed portions of the body of the switch 12. As is explained in the aforementioned patents the end walls of the switch 12, through which the contacts 14 and 16 are sealed, are flexible, corrugated diaphragm members which permit reciprocable relative movement of the cylindrical contacts from the closed contact position seen in FIG. 1, to an open contact position with the contacts separated a short distance apart of about 0.15 inch. The switch 12 is designed for low DC voltage of less than about 10 volts DC across the switch, and has a high continuous current rating of at least 6,000 amperes. The switch contacts can be fluid cooled to further increase the continuous current rating of such switches. A plurality of such switches are typically connected in electrical parallel to form a shunt switch assembly.

The switch 12 and contacts 14 and 16 are connected respectively to a flexible bus conductor 18 and a rigid bus conductor 20 which are in turn connected to the electrochemical cell terminals not shown. Planar connecting members 22 and 24 facilitate connection via bolts 26 of the buses 18 and 20 to the contacts 14 and 16. A pair of C-shaped insulating mounting members 27 and 28 are disposed about opposed sides of the switch 12, with the buses 18 and 20 extending out the other opposed sides between the members 27 and 28. One end of each of members 27 and 28 is connected via bolts 26 to the rigid bus 20. The other end of each of members 27 and 28 is connected via bolts 32 to a double acting air cylinder reciprocating operating means 34. The air cylinder means 34 comprises a body portion which is rigidly connected via members 27 and 28 as explained to the rigid bus 20 to the lower switch contact 16. A reciprocable drive rod 36 extends from the air cylinder means 34, and is connected via mounting conductor plate 38 to the flexible bus 18 and the switch contact 14. It can be appreciated that reciprocable movement of rod 36 causes reciprocal motion of the switch contact 14 to open and close the switch. Air connector 40 and air connector 42 are provided with the double acting air cylinder means 34 to serve as air inlet and outlet means.

The drive rod 36 is a threaded member, and annular adjustable inner anchor means 44 is threaded onto drive rod 36. This inner anchor means 44 is adjustable along the axial length of rod 36, and spanner wrench receiving apertures 46 are provided in anchor means 44 to permit turning adjustment of anchor means 44 along the length of rod 36. An annular outer anchor means 48 is rigidly mounted to the C-shaped members 27 and 28 via mounting bolts 50.

A Belleville washer 52 is disposed between and supported by the inner anchor means 44 and outer anchor means 48. An inner retaining ring 54 is fitted in a groove 53 in the inner anchor means 44 to retain the inner perimeter portion 56 of the annular Belleville washer 52 in place. Likewise, outer retaining ring 58 is fitted in a groove 59 in the outer fixed anchor means 48 to retain the outer perimeter portion 60 of the washer 52 in place.

The Belleville washer 52 and the switch 10 are seen in FIG. 1 in the closed contact position, with drive rod 36 extending downward to force contact 14 into current carrying contact with contact 16. The inner anchor means 44 moves downward with rod 36 to the position shown in FIG. 1, and this moves the inner perimeter portion 56 of the Belleville washer downward, flexing the washer 52 so that it is convex when viewed from below looking up along the rod axis. The Belleville washer is then latched to keep the contacts 14 and 16 closed in the absence of an unlatching force sufficient to overcome the washer force in the closed position. Even if air pressure for the air cylinder operating means 34 fails when the contacts are closed, the Belleville washer force will keep the contacts closed.

When it is desired to open the contacts, the double acting air cylinder operating means 34 is reversed, and drive rod 36 is reciprocated in an upward direction with a force sufficient to overcome the Belleville washer force pulling contact 14 away from contact 16, and moving the inner anchor means 44 upward with rod 36. This also moves the Belleville washer inner perimeter portion 56 upward, and it will reverse the direction of flex of the washer 52 so that it will be concave as viewed from below. This open circuit position is also a latched position since it will require positive downward force sufficient to overcome the Belleville washer force before the contacts can be moved from the open circuit position.

By way of an example, the Belleville washer 52 is formed of 0.040 thick phos-bronze metal with an inside diameter of 1.5 inch and a 3 inch outside diameter. The cupped height of the Belleville washer when in the open contact position is 0.115 inch.

Figure 2:
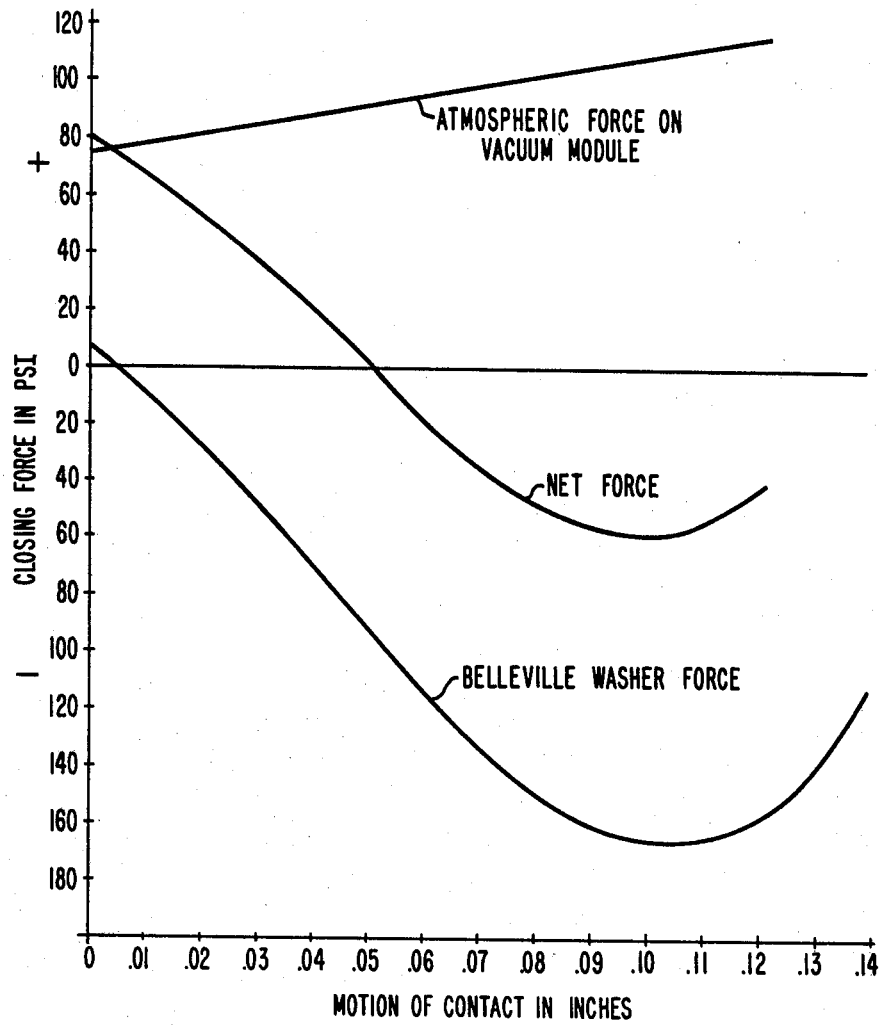
FIG. 2 is a plot of the closing forces versus contact displacement of the switch and operating mechanism of the present invention.

The forces applied to the switch contacts by the Belleville washer and the normal atmospheric pressure which acts upon the flexible hermetically sealed, evacuated switch body are summarized in FIG. 2, in which closing force in pounds per square inch are plotted against contact motion in inches. A net force from the summation of the atmospheric pressure force and the Belleville washer force is seen ranging from the contact closed position at 0 contact displacement to the contact open position at 0.12 inch contact displacement or separation.

Figure 3:
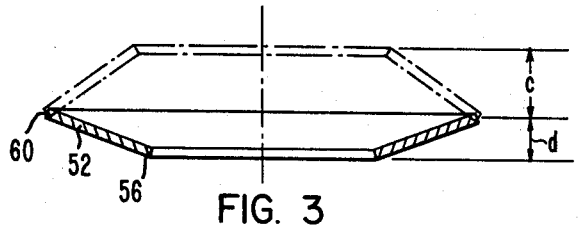
FIG. 3 is a schematic illustration showing the operation of the Belleville washer latching means from the closed to open position.

A representation of the Belleville washer deflection and flexing from open contact position to closed contact position is shown in FIG. 3 to facilitate understanding of this switch latching operation.

The Belleville washer 52 is seen in solid line form in FIG. 3 in the closed contact position. In this position, the distance d of the cupped or transverse height of the washer from the position of the fixed outer perimeter portion 60 to the flexed toward the switch position of the inner perimeter portion 56 is about 0.040 inch. The Belleville washer is illustrated in dotted line form in the contact open position and flexed in the opposite direction away from the switch, with the cupped or transverse height C from the fixed outer perimeter portion 60 to the plane of the inner perimeter portion 56 being about 0.115.

The Belleville washer latching means of the present invention thus provides safety latching in both the open and closed contact switch position. The washer acts like a toggle in flexing from the closed to open contact positions as a positive safety feature.

We claim:

1. An improved operating mechanism for a low DC voltage, high continuous current electrical shunting switch which comprises a hermetically sealed switch body, with reciprocably movable switch contacts extending through opposed portions of the switch body, which operating mechanism includes reciprocating actuating means connected to one of the switch contacts for moving the switch contact toward and away from the other switch contact within the switch body to a closed contact position and an open contact position, the improvement comprising a latching means connected between the reciprocating actuating means and a rigid mounting means, which latching means maintains the switch contacts in either the closed contact position or open contact position until predetermined force is applied via the reciprocating actuating means to overcome the latch condition and permit movement of the switch contact, and wherein the latching means comprises a Belleville type washer, the outer perimeter of which is rigidly retained by rigid mounting means, and the inner perimeter of which is connected to the reciprocating actuating means and is movable therewith from a latched open contact position to a latched closed contact position, and wherein the reciprocating actuating means includes a threaded drive rod connected to one switch contact, and an adjustable inner anchor means is threaded onto the drive rod, with the inner perimeter of the Belleville type washer retained by the adjustable inner anchor means.

2. The improved operating mechanism set forth in claim 1, wherein the Belleville type washer has a disked or cupped height to washer thickness ratio of about 2 to 3.

3. The improved operating mechanism set forth in claim 1, wherein the latching force exerted by the Belleville washer in the switch contact open and closed position can be adjusted by moving the adjustable inner anchor means along the threaded drive rod.

* * * * *